United States Patent [19]

Eichfeld et al.

[11] Patent Number: 4,508,274

[45] Date of Patent: Apr. 2, 1985

[54] ADJUSTABLE FLOW COOLANT NOZZLE

[76] Inventors: Timothy J. Eichfeld; Horace C. Disston, both of 217 S. Hurffville Rd., Deptford, N.J. 08096

[21] Appl. No.: 551,890

[22] Filed: Nov. 15, 1983

[51] Int. Cl.[3] ..... B24B 55/02; B05B 1/20

[52] U.S. Cl. ..... 239/455; 51/267; 118/315; 137/625.3; 239/553.3; 239/563; 239/590.3

[58] Field of Search ..... 239/438, 443, 456, 563, 239/566, 582, 554, 455, 553, 590.3, 553.3; 222/486, 485, 484; 137/625.3; 118/DIG. 4, 315; 51/266, 267; 184/6.14

[56] References Cited

U.S. PATENT DOCUMENTS

| | | | |
|---|---|---|---|
| 1,776,542 | 3/1927 | Carrington | 239/563 X |
| 1,776,545 | 9/1930 | Carrington | 239/563 X |
| 2,295,522 | 10/1941 | Shorter | 239/553.3 |
| 2,673,763 | 3/1954 | Dunn | 239/553.3 X |
| 2,865,830 | 12/1958 | Zoldas | 239/553.3 X |
| 3,228,614 | 1/1966 | Bauer | 239/553.3 X |
| 3,565,347 | 2/1971 | Denninger | 239/563 X |
| 3,878,991 | 3/1975 | Sabadics et al. | 239/456 |
| 3,970,417 | 7/1976 | Page | 239/553.3 X |

FOREIGN PATENT DOCUMENTS

| | | | |
|---|---|---|---|
| 2409544 | 9/1974 | Fed. Rep. of Germany | 239/590.3 |

*Primary Examiner*—Andres Kashnikow
*Assistant Examiner*—Kevin Patrick Weldon
*Attorney, Agent, or Firm*—Robert K. Youtie

[57] ABSTRACT

A coolant nozzle of adjustably variable width stream for a grinding wheel or the like, the nozzle including a hollow housing extending laterally across the working face of the grinding wheel having a coolant inlet in an upper region and a coolant outlet extending laterally in a lower region, a tubular formation extending laterally across the interior of the housing having a coolant receiving opening on its upper side adjacent to one end of the tubular formation and a coolant discharging port configuration on its lower side extending the length of the tubular formation. A control element or closure extends across the tubular formation and is shiftable longitudinally along the tubular formation to communicate the upper receiving port with a selected length of lower discharging port.

8 Claims, 3 Drawing Figures

FIG. 1
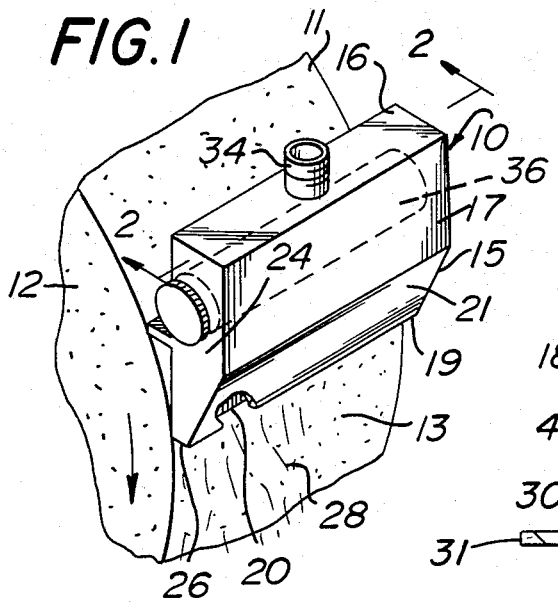
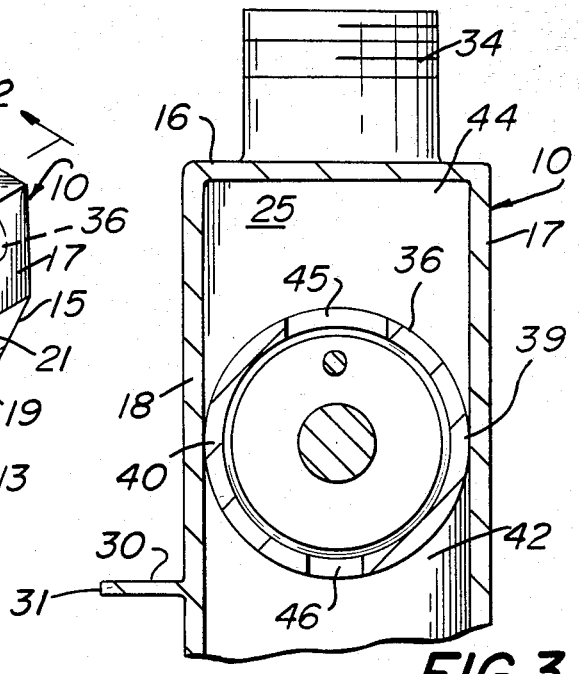
FIG. 3
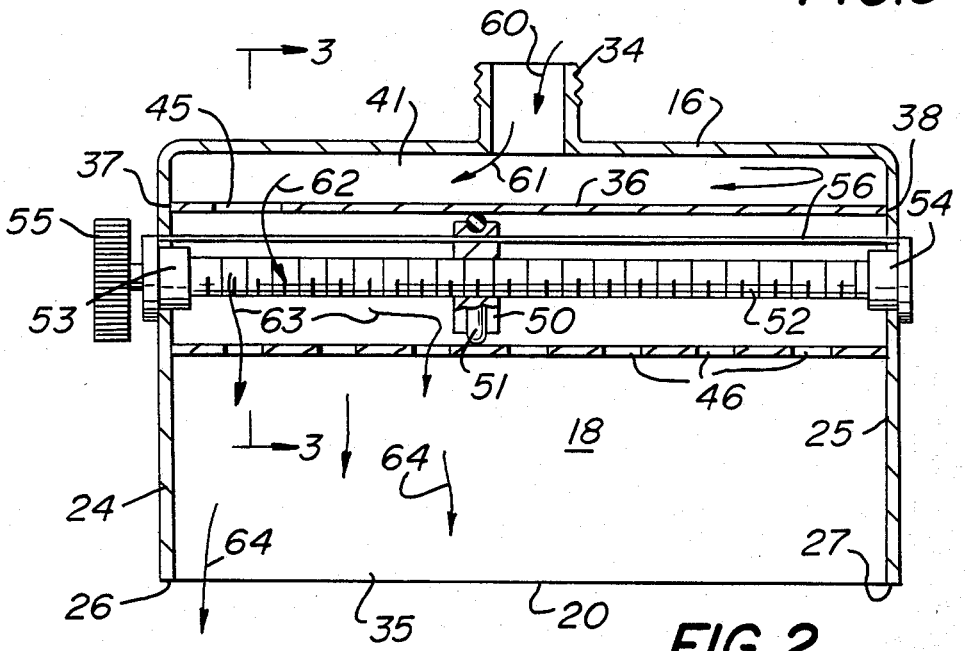
FIG. 2

ADJUSTABLE FLOW COOLANT NOZZLE

BACKGROUND OF THE INVENTION

While the adjustment of coolant nozzle flow has been provided for some time, the means and mechanisms of the prior art are relatively complex and expensive, as well as difficult to use and adjust. Representative of the prior art of which applicant is aware are the below listed prior patents:

| U.S. PAT. NO. | PATENTEE |
|---|---|
| 1,416,462 | HANSON |
| 2,434,679 | WAGNER ET AL. |
| 2,546,805 | WEISS ET AL. |
| 2,924,873 | KNOWLES |
| 3,325,949 | FISHER |
| 3,334,451 | HUTTON |
| 3,543,451 | SMITH |
| 3,548,549 | DUNN |
| 3,628,293 | KOBAYASHI ET AL. |

SUMMARY OF THE INVENTION

It is among the objects of the present invention to provide a flow coolant nozzle for use with grinding wheels and the like which enable an operator by mere turning of the nozzle to select the desired width of coolant stream required for use with the work being performed.

It is a further object of the present invention to provide a coolant nozzle of adjustable stream width which is extremely simple in construction for economy in manufacture and reliability in operation throughout a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a coolant flow nozzle of the present invention in operative association with a grinding wheel.

FIG. 2 is a sectional elevational view taken generally along the line 2—2 of FIG. 1.

FIG. 3 is a sectional elevational view taken generally along the line 3—3 of FIG. 2.

DESCRIPTION OF THE PREFERRED EMBODIMENT

Referring now more particularly to the drawings, and specifically to FIG. 1 thereof, a nozzle is there generally designated 10, and illustrated in operative relation with respect to a grinding wheel 11. That is, the nozzle 10 is located in front of the grinding wheel and just above the working area of the grinding wheel for passing coolant over the grinding wheel working area. Any suitable mounting means may be provided to properly locate the nozzle 10 with respect to the grinding wheel 11.

The grinding wheel 11 may be generally cylindrical, including a pair of opposite, parallel side or end walls

12, and a generally cylindrical surface 13 extending between the end walls 12, the front region of the cylindrical surface defining the working area of the grinding wheel.

The nozzle 10 may include a housing 15 of generally hollow construction and at least, generally laterally coextensive with the cylindrical grinding wheel surface 13 between the opposite grinding wheel ends 12. Thus, the hollow housing 15 extends generally horizontally, above the working region of the grinding wheel 11, and may include a generally horizontal top wall 16 from which depend generally vertical front and back walls 17 and 18. The front and back walls 17 and 18 depend from the front and rear edges of the top wall 16 and depend generally coextensively to spaced lower edges, as at 19 and 20, respectively.

The lower region 21 of the front wall 17 declines rearwardly toward the lower region of the rear wall, so that the lower edges 19 and 20 are in spaced parallelism with each other, but closer together than the upper regions of the front and back walls 17 and 18. The lower edge 20 of the rear wall 18 is proximate to and extends laterally across the cylindrical surface 13 of the grinding wheel 11.

Opposite end walls 24 and 25 depend generally vertically from opposite ends of the top wall 16, forwardly and rearwardly between the front and rear walls 17 and 18 to close opposite ends of the housing 10. The lower edges 26 and 27 of housing end walls 24 and 25, respectively, are generally coplanar with the lower ends or edges 19 and 20 of the housing front and rear walls 17 and 18. As will appear presently, the lower end edges 19, 20, 26 and 27 of the housing 10 define a generally horizontal downwardly opening outlet for coolant, as at 28, directed to the wheel surface 13.

Projecting externally from the rear housing wall 18 may be a generally horizontal flange 30 terminating at a rearward edge 31 extending along and proximate to the cylindrical surface 13 of grinding wheel 11. The flange or lip 30 will serve as an air layer spoiler to break up the layer of air moving with the grinding wheel surface 13.

The top wall 16 of the housing 10 may be provided with an upstanding tubular connection or nipple 34 which may be connected by suitable fluid conduit means (not shown) to a source of coolant, say a coolant reservoir and pump. Thus the nipple 34 opens into the interior of the housing 10 and defines a coolant inlet to the housing.

Interiorly of the housing 10, spaced vertically between the upper end coolant inlet 34 and lower end coolant outlet 35 (defined between the lower end edges 19, 20, 26 and 27), there is provided a generally horizontally disposed tubular formation 36. More specifically, the tubular formation 36 extends longitudinally between and has its opposite ends adjacent to opposite housing end walls 24 and 25, while being of a diameter to extend forwardly and rearwardly between the front and rear housing walls 17 and 18. The tubular formation 36 may be formed of a generally cylindrical tube section suitably secured in the housing 10, as by welding or otherwise, with its opposite ends 37 and 38 in engagement with respective housing end walls 24 and 25, and horizontally opposed longitudinal portions of the tube, as at 39 and 40, generally tangent to the front and rear walls 17 and 18 of the housing. Thus, the tubular formation 36 may be seen to subdivide the interior of the housing 10 into an upper region 41 above the tube 36 and a lower region 42 below the tube.

Adjacent to one end of the tube 36, say the end 37, there is formed in an upper region of the tube a relatively large through opening or receiving port 45. This port communicates through the upper housing chamber 41 with the coolant inlet 34. The lower region of the tube 36 is formed with a longitudinally extending, elongate port formation, which may be defined as shown, by a plurality of adjacent, spaced through apertures 46. Thus, the apertures 46 may be arranged in a row on the lower region of the tube 36 extending between opposite housing end walls 24 and 25. Other suitable elongate port means may be employed, such as elongate openings or slots.

A control element or closure 50, in the nature of a piston or disc is engaged in the tube 36, extending transversely thereacross, and defining a partition or closure in the tube. Specifically, the control element 50 may be a disc having circumposed thereabout a sealing element or O-ring 51 in sealing engagement with the interior of the tube 36.

An elongate, externally threaded member or positioning element 52 extends coaxially through the tube 36, having its opposite ends journaled, as in bearings 53 and 54 for axial rotation by manual actuation, as of the actuating member or knob 55 keyed to the threaded member or shaft and located exteriorly of the housing, as adjacent to the end wall 24.

The positioning member or threaded shaft 52 extends in threaded engagement centrally through a control element or disc 50. In addition, suitable means are provided to hold the control element or disc 50 against rotation while permitting of its movement longitudinally along the interior of the tube 36 upon rotation of the shaft 52. A rod 56 extending slidably through the control element, eccentrically thereof, and having is opposite ends secured in respective end walls 24 and 25 may serve to prevent rotation of the control element.

Thus, upon manual rotation of the knob 55, to rotate the threaded positioning shaft 52, the control element or disc 50 is shifted along the interior of the tube 36 to a desired position, say that illustrated in FIG. 3. In this position of control element 50, liquid coolant may enter the inlet 34 in the direction of arrows 60 and 61 into the upper housing chamber 41, thence passing downwardly through coolant receiving port 45 into the interior of tube 36, but only on the leftward side of the tube closing control element or disc 50, as in the direction of arrow 62. From the interior of tube 36 on the left hand side of the control element 50, the coolant may flow downwardly through the discharging port means 46 on the left hand side of control element 50, as indicated by arrows 63, and thence flow downwardly through outlet 35, as indicated by arrow 64, having a lateral stream dimension or width controlled by the position of control element 50. Of course, the control element 50 may be shifted between its extreme positions to selectively vary the stream width substantially as desired, within the limits of the nozzle 10.

From the foregoing, it is seen that the present invention provides a coolant nozzle of selectively variable stream width, which is extremely simple in construction, having relatively few moving parts subject to wear, quick and easy to operate the desired stream width, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A coolant nozzle of variable width stream for a grinding wheel or the like, said nozzle comprising a hollow housing for location extending laterally across the working surface of a grinding wheel, a coolant inlet in an upper region of said housing, a coolant outlet extending laterally in a lower region of said housing between opposite sides thereof, a laterally extending elongate tubular formation in said housing, coolant receiving port means adjacent to one end of said tubular formation in fluid communication with said coolant inlet, coolant discharging port means extending longitudinally along a lower region of said tubular formation and communicating with said coolant outlet, said receiving and discharging port means being in direct fluid communication with each other, a control element shiftable in said tubular formation to close fluid communication between said receiving port means and a selected length of said discharge port means, the remaining length of said discharge port means communicating with said receiving port means to pass a coolant stream of selected width through said outlet, and control element positioning means for selectively positioning said control element in said tubular formation to obtain the desired stream width.

2. A coolant nozzle according to claim 1, said discharge port means and said outlet being substantially coextensive, for direct outflow of said stream.

3. A coolant nozzle according to claim 1, said control element being slidable along said tubular formation in sealing relation therewith, and said control element positioning means comprising a rotary lead screw threadedly engaged with said control element and extending exteriorly of said housing for rotation by an operator to position said control element.

4. The coolant nozzle according to claim 1, said tubular formation comprising a cylindrical tubular section in said housing and extending entirely thereacross in the horizontal plane for communicating between the upper and lower housing regions only through said receiving and discharging port means.

5. A coolant nozzle according to claim 4, said control element comprising a piston in sealing engagement in said cylindrical tube.

6. A coolant nozzle according to claim 5, said discharging port means comprising a row of openings in the lower region of said tube.

7. A coolant nozzle according to claim 6, said coolant outlet comprising a slot in facing relation with said row of openings.

8. A coolant nozzle according to claim 7, said housing comprising an elongate laterally extending top wall, front and back walls laterally coextensive with and depending from said top wall and in tangential relation with the front and back of said tube, and opposite side walls depending from opposite ends of said top wall between said front and back walls in closing relation with respective ends of said tube, the lower housing end being open to define said coolant outlet.

* * * * *